United States Patent [19]

Bengtsson et al.

[11] Patent Number: 4,480,727

[45] Date of Patent: Nov. 6, 1984

[54] ELECTROMAGNETIC TRACK BRAKE FOR A RAILWAY VEHICLE

[75] Inventors: Nils K. Bengtsson, Dalby; Egil K. Ljung, Bjärred, both of Sweden

[73] Assignee: SAB Industri AB, Landskrona, Sweden

[21] Appl. No.: 403,498

[22] PCT Filed: Nov. 10, 1981

[86] PCT No.: PCT/SE81/00331

§ 371 Date: Jul. 16, 1982

§ 102(e) Date: Jul. 16, 1982

[87] PCT Pub. No.: WO82/01691

PCT Pub. Date: May 27, 1982

[30] Foreign Application Priority Data

Nov. 19, 1980 [SE] Sweden ..... 8008097

[51] Int. Cl.[3] ..... F16D 65/34

[52] U.S. Cl. ..... 188/165; 188/41

[58] Field of Search ..... 188/164, 165, 41; 105/76, 77, 78

[56] References Cited

U.S. PATENT DOCUMENTS

| | | | |
|---|---|---|---|
| 3,723,795 | 3/1973 | Baerman | 188/165 |
| 3,768,607 | 10/1973 | Marzocco | 188/165 |
| 4,299,312 | 11/1981 | Bengtsson et al. | 188/165 |

FOREIGN PATENT DOCUMENTS

| | | | |
|---|---|---|---|
| 0914981 | 7/1954 | Fed. Rep. of Germany . | |
| 2361312 | 6/1975 | Fed. Rep. of Germany . | |
| 2712850 | 9/1977 | Fed. Rep. of Germany . | |
| 0127483 | 7/1946 | Sweden . | |
| 0118017 | 1/1947 | Sweden . | |
| 0414477 | 8/1980 | Sweden . | |
| 0185029 | 11/1935 | Switzerland . | |
| 614641 | 12/1948 | United Kingdom | 188/165 |

*Primary Examiner*—Bruce H. Stoner, Jr.
*Assistant Examiner*—Alvin Oberley
*Attorney, Agent, or Firm*—Laurence R. Brown

[57] ABSTRACT

An electromagnetic track brake for a railway vehicle comprises an elongate brake energizing coil for energizing a plurality of U-shaped braking shoes mounted in a row on a rigid frame. To improve transmission of braking reaction forces from the shoes to the vehicle each shoe is moved downwards individually relative to the frame against spring bias. A tie rod extends along a lower branch of the coil engaging each of the braking shoes for the transmission of braking forces from the shoes to the tie rod. A cylindrical rod rigidly coupled to the frame is operably connected to the end of the tie rod to take up the braking reaction forces transmitted to the tie rod.

7 Claims, 3 Drawing Figures

II
III
2
4
6
7
8
9
10
12
13
14
15
16
17
18
19
20
23
24
25
26
27
29
30
31
32
33
34
38
39
40
41
42
43

ELECTROMAGNETIC TRACK BRAKE FOR A RAILWAY VEHICLE

TECHNICAL FIELD

This invention relates to an electromagnetic track brake to be mounted on a railway vehicle for cooperation with a rail and comprising an elongate brake energizing coil, a rigid frame, and a plurality of U-shaped braking shoes mounted in a row in the frame around the lower branch of the coil and having braking surfaces disposed beneath the coil to frictionally engage the rail when the coil is energized.

BACKGROUND ART

Electromagnetic track brakes of this type are well known in the art. Typical for the prior art brakes is that the frame for the elongate brake energizing coil is suspended from the vehicle, viz. the bogie or truck frame, over the rail in such a way that the braking force is transmitted from the braking shoes to the vehicle over the coil and its normally enclosing frame. Accordingly, the coil frame partakes in the force transmission between the braking shoes and the vehicle and therefore has to be of a sturdy and reliable construction. Moreover, the transmission of braking forces over the coil frame provides a less favourable taking-up of the torque and forces involved, so that uneven wear of the braking shoes may occur.

DISCLOSURE OF INVENTION

The disadvantages mentioned above are obviated by the invention which provides an electromagnetic track brake of the type referred to, in which each braking shoe is individually movable in a vertical direction relative to the frame and is lightly biased upwards towards a rest position, preferably by means of springs.

Further, the track brake has a tie rod extending along the lower branch of the coil and a covering therefor and engaging each of the braking shoes for the transmission of braking reaction forces from the shoes to the tie rod, and also has means rigid with the frame of the vehicle and operatively connected to the end of said tie rod to take up the braking reaction forces transmitted to the tie rod.

In this way the coil will be relieved from the transmission of the braking reaction forces and accordingly can be of a simple and cheap construction. No normal coil frame will be required, only a protective covering.

A further advantage is that the mounting of the coil to the vehicle is facilitated due to the fact that no braking reaction forces are carried over such mounting. Preferably, the brake is suspended from the journal boxes of the vehicle.

The means operatively connected to one end of the tie rod can easily be integrated with the bogie or truck frame of the vehicle and preferably consists of a sturdy bracket supporting a substantially vertical rod which is engaged by an eye at the end of the tie rod, said eye being displaceable along the rod.

BRIEF DESCRIPTION OF THE DRAWINGS

The invention will be described in further detail below, reference being made to the accompanying drawings in which.

DESCRIPTION OF THE PREFERRED EMBODIMENT

Figure 1:
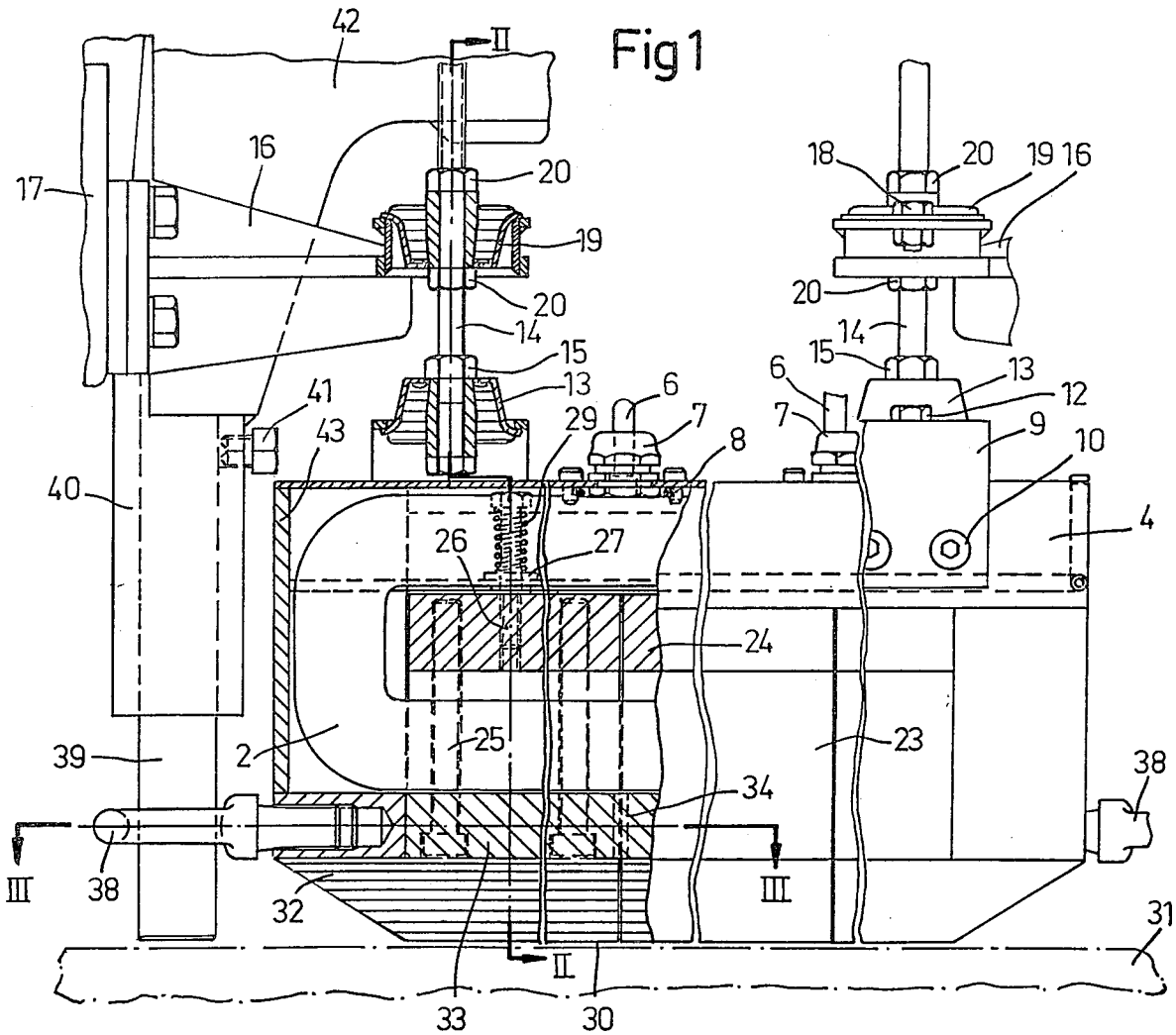
FIG. 1 is a side view, partly a longitudinal cross-sectional view, of an electromagnetic track brake according to the invention.

The total length of the electromagnetic track brake illustrated in the drawings is chosen, within the limits set by the space available in the underframe of a railway vehicle, according to the requirements as to the braking capacity. However, in the drawing the brake is partly cut away and is not shown in its full length, which normally may be of the order of 1 meter.

The brake comprises an elongate energizing coil 1 of a slightly different type than the one conventionally used in electromagnetic track brakes. It is enclosed by a substantially oval covering 2, which is only protective and not force-transmitting and may be made of epoxy resin. The coil covering with the coil enclosed therein lies protected in a U-shaped bracket 3, mounted by screw connections 5 to the lower side of a non-magnetic channel 4 open downwards.

Cables 6 for the electrical connection of the coil are extended from the covering 2 through bushings 7 projecting from the upper side of the channel 4, a gasket 8 being provided around each bushing between the covering 2 and the channel 4.

U-shaped brackets 9 embrace the channel 4 and are connected to angle bars 21 described below but also to the channel by means of screws 10. In an opening 11 in the web of each bracket there is mounted by means of screw connections 12 a shock-absorbing bushing 13, and a suspension bolt 14 is passed from below through the bushings 13 and is connected therewith by means of a nut 15 screwed onto the bolt. A bracket 16 is rigidly mounted to a journal box 17 —so as to follow the movements of the vehicle wheel—and has fixedly mounted thereto by screw connections 18 a shock-absorbing bushing 19 of the same type as the bushing 13. The bolt 14 is passed through the bushing 19 and is connected therewith by nuts 20 screwed onto the bolt. Thus, it will be seen that the coil covering 2 is suspended from brackets 16 on two adjacent journal boxes of the vehicle and can be adjusted vertically by screwing the nuts 20 on the bolts 14.

Inside the channel 4 angle bars 21 are connected to the brackets 9 by means of the screws 10, a damp insulating lining 22 being provided between the angle bars and the channel on the inner side of the channel.

These angle bars 21 serve as supporting means for the coil 1 with its coil covering 2 and the channel 4.

The design so far described will see to it that the magnetic flux is not closed in an "upper" loop, i.e. through the members 3, 4 or 21, 9.

A number of individual U-shaped braking shoes, each consisting of two limbs 23 and a web 24 interconnected by screws 25, are mounted in a row on the angle bars 21, said shoes being made of a ferromagnetic material. The mounting of the braking shoes is accomplished by means of bolts 26 passing through bushings 27 in the angle bars 21 and screwed into the web 24. Between each bushing 27 and the head 28 of the bolt 26, passing through the bushing, a helical pressure spring 29 is mounted to bias the braking shoe in an upward direction. As will be seen, the web 24 of the braking shoes thus mounted extends through the central aperture of the elongate coil covering 2, and the relationship between the dimensions of the web and the aperture are such that the individual shoes are vertically displaceable over a limited distance.

Figure 3:
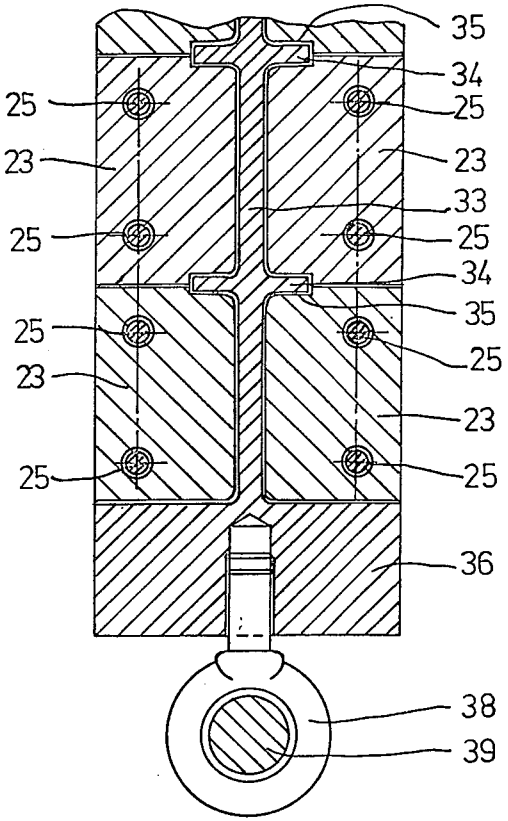
FIG. 3 is a cross-sectional view taken along line III—III in FIG. 1.
Figure 2:
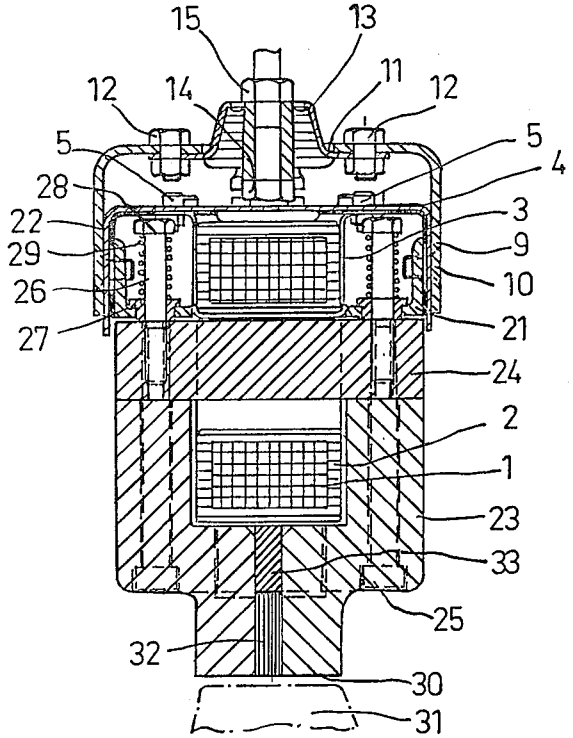
FIG. 2 is a cross-sectional view taken along line II—II in FIG. 1.

The limbs 23 of each braking shoe form braking surfaces 30 for co-operation with a rail fragmentarily indicated by dot and dash lines at 31. The limbs are mutually spaced by a gap, which is partly filled by a non-ferromagnetic material 32 in the portion thereof adjacent the surfaces 30. A tie rod 33 extending from one end of the row of braking shoes to the other end of said row is received by the open portion of the gap at a loose fit. This tie rod has rectangular cross section and forms a number of transverse flanges 34 projecting from opposite sides of the tie rod and having a longitudinal spacing corresponding to the length of the individual braking shoes 23, 24. The flanges 34 are received at loose fit in recesses 35 formed by the facing end surfaces of adjacent braking shoes as is seen in FIG. 3. At the ends the tie rod has a head 36 of the same width as the braking shoe parts 23. An eye 38 is screwed into the head 36.

A cylindrical rod 39 is adjustably fixed in a socket 40 by means of a set screw 41, said socket being of a sturdy construction and being fixedly connected to the underframe 42 of the vehicle, e.g. by welding. The socket may also form an integral part of the underframe. The eye 38 at each end of the row of braking shoes is passed onto the rod 39 which thus forms means for anchoring the braking shoes to the underframe 42 allowing vertical movement of the tie rod 33 together with the braking shoes.

End walls 43 are welded to the angle bars 21, so that a sturdy frame 21, 43 for the track brake is formed.

Normally, during operation of the vehicle, the braking shoes are maintained in an upper position against the angle bars 21 under the bias of the pressure springs 29. In this position of the braking shoes, the braking surfaces 30 are maintained rather closely spaced from the rail 31, the space between the surfaces 30 and the rail 31 being determined by the adjustment of the nuts 20.

When the brake described is to be engaged, the coil 1 is energized to produce an electromagnetic flux which will flow in a closed path through the shoes 23, 24 and the rail 31, on which the vehicle runs. The braking surfaces 30 thus will be attracted to the rail and will frictionally engage the rail surface. The braking reaction forces thus produced will be transmitted from the row of braking shoes to the tie rod 33 over the flanges 34 and will be transmitted from the tie rod to the rod 39 on the underframe 42 of the vehicle and thus will brake the vehicle. It will be seen that by the arrangement of the tie rod 33 operatively engaging the braking shoes 23, 24, the bolts 14 and the connections between the bolts and the coil frame at the bushings 13 on one hand and between the bolts and the journal boxes at the bushings 19 on the other hand are completely relieved of the braking reaction forces.

We claim:

1. An electromagnetic track brake to be mounted on a railway vehicle for co-operation with a rail and comprising in combination, an elongate brake energizing coil having a lower disposed branch to be disposed generally parallel to the rail, a rigid frame therefor, a plurality of generally U-shaped braking shoes mounted in a row in the frame around the lower branch of the coil and having braking surfaces disposed beneath the coil for frictionally engaging the rail when the coil is energized, means mounting each braking shoe individually movable in a vertical direction relative to the frame and lightly spring biased upwards away from the rail towards a rest position, said track brake being mounted on a vehicle frame, a tie rod extending exteriorly along the lower branch of the coil, a covering therefor and engaging each of the braking shoes for the transmission of braking reaction forces from the shoes to the tie rod, and means rigid with the vehicle frame and operatively connected to the end of said tie rod to take up the braking reaction forces transmitted to the tie rod.

2. A track brake according to claim 1, characterized in that said rigid means is so operatively connected to the tie rod that substantial vertical displacement of the tie rod is allowed.

3. A track brake according to claim 2, characterized in that said rigid means comprises a substantially vertical anchoring rod rigid with the vehicle frame, and that the tie rod has an eye at the end thereof, passed onto said anchoring rod and longitudinally displaceable thereon.

4. A track brake according to claim 1, characterized in that the tie rod extends along the row of braking shoes in the gap formed between two limbs of the generally U-shaped braking shoes.

5. A track brake according to claim 4, characterized in that the tie rod has transverse members received between facing end surfaces of adjacent braking shoes.

6. A track brake according to claim 5, characterized in that said facing end surfaces of the braking shoes form recesses receiving said transverse members of the tie rod.

7. A track brake according to claim 5, characterized in that the transverse members of the tie rod are integral with the tie rod.

* * * * *